US011904994B2

(12) United States Patent
Wall

(10) Patent No.: US 11,904,994 B2
(45) Date of Patent: Feb. 20, 2024

(54) METHOD FOR CONTROLLING A WATER JET PROPULSION DEVICE

(71) Applicant: Kongsberg Maritime Sweden AB, Kristinehamn (SE)

(72) Inventor: Jan Wall, Kristinehamn (SE)

(73) Assignee: KONGSBERG MARITIME SWEDEN AB, Kristinehamn (SE)

( * ) Notice: Subject to any disclaimer, the term of this patent is extended or adjusted under 35 U.S.C. 154(b) by 298 days.

(21) Appl. No.: 17/504,451

(22) Filed: Oct. 18, 2021

(65) Prior Publication Data

US 2022/0144399 A1 May 12, 2022

(30) Foreign Application Priority Data

Nov. 6, 2020 (SE) ..... 2051296-8

(51) Int. Cl.
*B63H 11/11* (2006.01)
*B63H 11/08* (2006.01)
(Continued)

(52) U.S. Cl.
CPC ..... *B63H 11/11* (2013.01); *B63H 11/08* (2013.01); *B63H 11/113* (2013.01); *B63H 11/117* (2013.01); *B63H 23/30* (2013.01)

(58) Field of Classification Search
CPC ..... B63H 11/11; B63H 11/08; B63H 11/113; B63H 11/117; B63H 23/30; B63H 21/21;
(Continued)

(56) References Cited

U.S. PATENT DOCUMENTS 3,601,989 A * 8/1971 Austin ..... B63H 11/08 60/221
6,230,642 B1 5/2001 McKenney et al.
(Continued)

FOREIGN PATENT DOCUMENTS

EP 0 778 196 A1 6/1997

OTHER PUBLICATIONS

Search Report for Swedish Patent Application No. 2051296-8, dated Jun. 16, 2021. (2 pages).

*Primary Examiner* — Andrew Polay
(74) *Attorney, Agent, or Firm* — FOLEY & LARDNER LLP

(57) ABSTRACT

The invention relates to a method for controlling a water jet propulsion device for the propulsion of a marine vessel, the water jet propulsion device comprising: a conduit extending between an inlet and an outlet; an impeller in the conduit; and a mechanical power provider arranged to deliver power to the impeller; the method comprising receiving a plurality of thrust commands, and controlling a thrust level of the water jet propulsion device in dependence the thrust commands, wherein controlling the thrust level comprises adjusting a position of a deflector arranged to deflect water flowing out of the outlet, characterised by coordinating the adjustment of the position of the deflector with a level of engagement of a clutch, arranged to adjust the delivery of power from the power provider to the impeller, so that the thrust level is substantially continuous in a thrust command domain.

17 Claims, 6 Drawing Sheets

(51) Int. Cl.
*B63H 11/113* (2006.01)
*B63H 11/117* (2006.01)
*B63H 23/30* (2006.01)

(58) Field of Classification Search
CPC . B63H 11/107; B63H 2011/081; B63H 11/10; Y02T 70/50
See application file for complete search history.

(56) References Cited

U.S. PATENT DOCUMENTS

| | | | | |
|---|---|---|---|---|
| 6,899,575 | B1 * | 5/2005 | Rothe | B63H 11/08 440/39 |
| 11,718,378 | B2 * | 8/2023 | Rantala | B63H 11/08 440/38 |
| 2001/0029134 | A1 | 10/2001 | Moffet | |
| 2003/0077956 | A1 * | 4/2003 | Borgli | B63H 21/30 440/83 |
| 2009/0215331 | A1 * | 8/2009 | Suzuki | B63H 23/30 440/1 |
| 2012/0276793 | A1 | 11/2012 | Minoura et al. | |
| 2016/0039506 | A1 | 2/2016 | Okamoto | |
| 2020/0047859 | A1 | 2/2020 | Kinomoto | |

* cited by examiner

METHOD FOR CONTROLLING A WATER JET PROPULSION DEVICE

CROSS-REFERENCE TO RELATED PATENT APPLICATIONS

This application claims priority to Swedish Patent Application No. 2051296-8, filed Nov. 6, 2020, which is incorporated herein by reference in its entirety.

TECHNICAL FIELD

The invention relates to a method for controlling a water jet propulsion device for the propulsion of a marine vessel. The invention also relates to a computer program, a carrier comprising the computer program, and a control module configured to perform the method.

BACKGROUND

A water jet propulsion device in a marine vessel may comprise a conduit extending between an inlet and an outlet, an impeller in the conduit, and a mechanical power provider, such as an engine, arranged to deliver power to the impeller. The inlet may be provided in a hull of the vessel, below the waterline of the vessel. The inlet may be provided forward of a transom of the vessel. The outlet may be provided in, or at, the transom of the vessel. The outlet may be at least partly above the waterline. Water introduced through the inlet, and propelled through the outlet, backwards in relation to the vessel, will cause a rection force, or thrust, propelling the vessel forward.

A water jet propulsion device for the propulsion of a marine vessel may comprise a steering device, arranged to swing an outlet of the water jet propulsion device. Thereby, a lateral control of the vessel may be provided. Further, a water jet propulsion device, e.g. for a large ship, may comprise a deflector, sometimes referred to as a bucket or a reversing plate, which can be gradually moved, which makes it possible to vary the thrust from full ahead via a zero thrust position to full astern and vice versa, e.g. as described in the article "Learn about Waterjet Propulsion System", available of the web on https://www.worldmaritimeaffairs-.com/learn-about-waterjet-propulsion-system/. A combination of the steering device and the deflector may be referred to as a steering and reversing gear.

Nevertheless, a problem, in particular with large water jet propulsion devices for ships, is that during manoeuvring in harbours, deflected water may damage docks, and/or stir up seabed sediments, which may cause environmental disturbance. Also, water deflected by the deflector, in a forward direction, may interfere with the steering function of the water jet propulsion device.

Thus, there is a desire to improve the control of water jet propulsion devices, e.g. for improving the steering function of the devices, and/or reducing or avoiding that, during manoeuvring in harbours, deflected water causing damages, and/or environmental disturbances.

SUMMARY

It is an object of the invention to improve the control of water jet propulsion devices.

This object is reached with a method according to claim 1. Thus, the invention provides a method for controlling a water jet propulsion device for the propulsion of a marine vessel, the water jet propulsion device comprising a conduit extending between an inlet and an outlet, an impeller in the conduit, and a mechanical power provider arranged to deliver power to the impeller, the method comprising receiving a plurality of thrust commands, and controlling a thrust level of the water jet propulsion device in dependence the thrust commands, wherein controlling the thrust level comprises adjusting a position of a deflector arranged to deflect water flowing out of the outlet, the method further comprising coordinating the adjustment of the position of the deflector with a level of engagement of a clutch, arranged to adjust the delivery of power from the power provider to the impeller, so that the thrust level is substantially continuous in a thrust command domain.

The vessel may be of any kind, e.g. a ship or a boat. The vessel may have a hull, a bow, and a stern. The conduit of the water jet propulsion device may extend between an inlet and an outlet. The outlet may be steerable for lateral control of the vessel. The impeller may be located between the inlet and the outlet. The impeller may be arranged to pump water from the inlet to the outlet. The mechanical power provider may be of any suitable kind, e.g. an internal combustion engine, an electric motor, a hydraulic motor, or a pneumatic motor. In case of an engine, the engine may be a piston engine, or turbine engine.

The deflector may be controllable to deflect water flowing out of the outlet, so as to the control the thrust of the water jet propulsion device. The deflector may be of any suitable kind, e.g. a reversing plate, or a bucket. As exemplified below, the deflector may be arranged to control the forward thrust of the propulsion device, or the reverse thrust of the propulsion device.

The method may comprise controlling the level of engagement of the clutch to control the delivery of power to the impeller. As exemplified below, the level of engagement of the clutch may be controlled or allowed. In the latter case, the nature of the clutch may be such that at a certain thrust command level, a clutch engagement step occurs.

The controls of the deflector and the clutch may be based on the thrust commands. It is understood that each thrust command may correspond to a requested thrust level. The thrust commands may indicate respective thrust command level. Each thrust level may be provided in response a respective thrust command level. The derivative of the thrust level with respect to the thrust command may be above zero. The relationship between the thrust level and the thrust command level may be proportional. The relationship between the thrust level and the thrust command level may be linear. In some embodiments, the relationship between the thrust level and the thrust command level may be non-linear. The thrust level may be e.g. a force or a power level. The thrust level may be expressed with any suitable measure, e.g. kN.

The thrust level is substantially continuous in a thrust command domain. Thereby, the thrust level is a substantially continuous function of the thrust command level. Since the adjustment of the deflector is coordinated with the level of engagement of the clutch, so that the thrust level is substantially continuous in a thrust command domain, there may be a continuous relationship between the propulsion power and the power demand. Such a continuous relationship may be provided all the way from zero thrust to a full clutch engagement.

The continuous relationship provides for a step-free relationship. Thereby, the thrust level may be continuous in a time domain. Thereby a smooth control of the thrust level may be obtained. Even if in some embodiments, the continuous relationship between the thrust level and thrust command level does not necessarily entail a continuous thrust in a time domain, e.g. in case of an abrupt manual handling of a thrust command control device, the invention allows for avoiding steps in the thrust level in cases of a smooth thrust command change.

The invention may be advantageous at low speed operations, and/or at transitions between low and high speeds. As exemplified below, where there are steps in the flow of water out of the outlet, e.g. due to steps in the clutch engagement level, or a need for a minimum flow for keeping the impeller primed, the deflector may be used for compensating for such steps. As also exemplified below, the clutch engagement may be such that the flow may be less than in the case of a fully engaged clutch. Thereby the flow of deflected water may be reduced at manoeuvring in harbours. In particular in the case of large vessels, this will reduce the risk of damage to docks, and/or excessive seabed sediment stir-up. Also, at a partially deflecting position of the deflector, where, in a forward moving manoeuvre of the vessel, the deflected flow may be up to 80% of the total flow, the steering function of the vessel may be improved by the reduced total flow, since the forwardly deflected flow will be reduced. In other words, a forwardly deflected flow, which during steering may cause a lateral force which is opposite to the desired steering force, may be reduced, thereby improving the steering handling of the vessel.

It is understood that the invention is applicable to cases where the thrust is directed mainly rearwards in relation to the vessel, i.e. in a direction from the bow to the stern, for providing a forwardly directed reaction force to the vessel. Such cases are herein referred to as cases of a forward driving thrust. It should however be noted that the invention is equally applicable to cases where the thrust is directed mainly forwards in relation to the vessel, i.e. in a direction from the stern to the bow, for providing a rearwardly directed reaction force to the vessel. Such cases are herein referred to as cases of a reversing thrust. Such a reversing thrust may be provided by means of the deflector, as exemplified below.

Herein, when reference is made to the thrust level, reference is made to the absolute value of the thrust level. Thus, a forward driving thrust, as well as a reversing thrust, are, for this presentation, both considered to have positive thrust levels. The same is understood regarding the thrust command level.

As exemplified below, embodiments of the invention comprise coordinated adjustments of the deflector and the clutch, so that the thrust level is substantially continuous in a thrust command domain. In a start-up sequence of the vessel, with a forward driving thrust, subsequently to the coordinated adjustments of the clutch and the deflector, the clutch may be fully engaged and substantially no water flowing out of the outlet is deflected. In a case of a reversing thrust, subsequently to the coordinated adjustments of the clutch and the deflector, the clutch may be fully engaged and substantially all water flowing out of the outlet is deflected. Subsequently to the coordinated control of the clutch and the deflector, the power provider may be controlled to increase the power to the impeller.

Preferably, the method comprises controlling the thrust level of the water jet propulsion device, within a deflector thrust command range, by the adjustment of the deflector, and controlling, within the deflector thrust command range, the level of engagement of the clutch, so as for the clutch to be partially engaged. Thereby, the clutch engagement level may be kept substantially constant within the deflector thrust command range. Thus, the thrust may be controlled, within the deflector thrust interval, by means of the deflector, while keeping the clutch engagement constant.

Preferably, the method comprises controlling the clutch for keeping the impeller primed within the deflector thrust command range. Thereby, the clutch engagement level may be at a priming minimum level providing a substantially minimal rotational speed of the impeller to keep the impeller primed. The minimal rotational speed may be a minimum rotational speed needed to allow water to flow through the conduit. The impeller being primed may mean that it is surrounded by water. As exemplified below, at lower speeds, the conduit may be at least partly filled with air. If there is air in the conduit, the impeller may need to become primed. As exemplified below, the impeller rotational speed required for getting the impeller primed may be higher than the impeller rotational speed required for keeping the impeller primed once the impeller has gotten primed.

The method may comprise controlling, at a lower end of the deflector thrust command range, the deflector so as to deflect water for a substantially zero thrust. Thereby, the deflector thrust command range may form a lower portion of a total thrust command range for a case of a forward directed thrust. Similarly, the deflector thrust command range may form a lower portion of a total thrust command range for a case of a reversing thrust.

The thrust of the water jet propulsion device may be considered to be parallel with the outlet flow, i.e. the flow of water coming out of the outlet. Water deflected by the deflector may be at least partly directed in a direction which is opposite to the outlet flow. Thus, water deflected by the deflector may flow with a component opposite to the outlet flow. The deflector may nevertheless create a flow of water having a component which is transverse to the outlet flow. Here, the component of the deflected flow which is opposite to the outlet flow, is referred to as the opposite deflected flow. The deflector may be arranged to deflect a portion of the flow coming out of the outlet, and the not deflect the remainder of the flow. Thereby, the resulting thrust of the water jet propulsion device may be regarded as a vector sum of the opposite deflected flow and the non-deflected portion of the outlet flow. For a zero thrust, this sum may be zero. For a forward driving thrust, the non-deflected portion of the outlet flow may be larger than the opposite deflected flow. For a reversing thrust, the opposite deflected flow may be larger than the non-deflected portion of the outlet flow. It may be noted that due to transverse components of the deflected flow, for a zero thrust, the deflected flow may need to be larger than the non-directed flow. For example, for a zero thrust, the deflected flow may be 60-90%, e.g. around 80%, of the outlet flow.

Embodiments where, within the deflector thrust command range, the thrust level is controlled by the adjustment of the deflector, and the clutch is controlled for keeping the impeller primed, may be particularly useful when operating in a lower portion of the total thrust command range, e.g. at low vessel speeds. Where the power provider is an engine, e.g. where the vessel is a ship, at idling, the engine may produce 10-20%, e.g. around 14%, of its maximum power. Further, at idling, the engine rotational speed may be 20-30%, e.g. around 25%, of the maximum rotational speed of the engine. This may provide a high outlet flow which, even if deflected for thrust control, may cause damages in harbours, and/or steering problems, as suggested above.

Since the clutch is only partially engaged, the impeller rotational speed can be reduced. Thereby, the outlet flow can be reduced. This may reduce the risk of damage to docks, and/or excessive seabed sediment stir-up. Also, the reduced outlet flow may improve the steering handling of the vessel. This is advantageous to any kind of vessel, e.g. a relatively light luxury yacht, which may display "nervous" handling characteristics. In addition, since the power delivered to the impeller is reduced, the operational cost of running the engine may be reduced; for ships, this may be a very significant advantage. Further, noise caused by the water jet propulsion device may be reduced.

The method may comprise controlling, at a higher end of the deflector thrust command range, the deflector to not deflect any water flowing out of the outlet. In particular, such a control may be provided in a case of a forward driving thrust. However, in a case of a reversing thrust, the method may comprise controlling, at a higher end of the deflector thrust command range, the deflector to deflect all water flowing out of the outlet.

The method may comprise gradually adjusting, within the deflector thrust command range, the deflector from a position where water flowing out of the outlet is deflected for a substantially zero thrust level, to a position where no water is deflected. In particular, such an adjustment may be provided in a case of a forward driving thrust. In the case of a reversing thrust, the method may comprise gradually adjusting, within the deflector thrust command range, the deflector from a position where water flowing out of the outlet is deflected for a substantially zero thrust level, to a position where all water is deflected. As a result of gradually adjusting the deflector position, a deflected share of the flow of water out of the outlet may be gradually increased or gradually decreased. For this presentation it is understood that an increasing deflector position provides an increasing share of the water being deflected. Generally, the method may comprise, within the deflector thrust command range, the time derivative of the deflector position once or repetitively remaining at zero for a period of time, once or repetitively being positive for a period of time, and/or once or repetitively being negative for a period of time.

Preferably, the method comprises controlling the thrust level of the water jet propulsion device, within a clutch thrust command range, different from the deflector thrust command range, by adjusting the level of engagement of the clutch. More generally, the adjustment of the deflector may be coordinated with an adjustment of the level of engagement of the clutch, so that the thrust level is substantially continuous in the thrust command domain. The clutch may be adjusted to adjust the delivery of power from the power provider to the impeller. Thereby, the thrust level of the water jet propulsion device may be adjusted. In preferred embodiments, there is, within the clutch thrust command range, a substantially continuous change of power to the impeller in the thrust command domain. For this, the level of clutch engagement may be gradual. In some embodiments, where the clutch is hydraulically controlled, a proportional valve may be provided for the adjustment of the engagement of the clutch. It should be noted though that in some embodiments, within the clutch thrust command range, the adjustment the level of engagement of the clutch, in the thrust command domain, may be stepped.

At a higher end of the clutch thrust command range, the clutch may be fully engaged. Preferably, the method comprises keeping the deflector position substantially constant within the clutch thrust command range.

Preferably, the clutch thrust command range extends from a priming minimum level with a clutch engagement level providing a substantially minimal rotational speed of the impeller to keep the impeller primed, to a thrust level, or a thrust command level, that is higher than at the priming minimum level. The higher thrust level may be a thrust level at which there is a full clutch engagement, or a threshold clutch engagement level. As exemplified below, at the threshold clutch engagement level there may be a step of the clutch engagement from the threshold clutch engagement level to a full clutch engagement.

The method may comprise gradually adjusting, within the clutch thrust command range, the clutch engagement level, from the priming minimum level, to the higher level. More generally, the method may comprise, within the clutch thrust command range, the time derivative of the clutch engagement level once or repetitively remaining at zero for a period of time, once or repetitively being positive for a period of time, and/or once or repetitively being negative for a period of time.

The deflector and clutch thrust command ranges may be adjacent. Thereby, one of the deflector and clutch thrust command ranges may start where the other one finishes. The deflector and clutch thrust command ranges may jointly extend from a first thrust command level to a second thrust command level. The deflector and clutch thrust command ranges may provide deflector and clutch thrust ranges, respectively. The deflector and clutch thrust ranges may be adjacent. The deflector and clutch thrust ranges may jointly extend from a first thrust level to a second thrust level. The second thrust level may be different from the first thrust level.

In some embodiments, the deflector and clutch thrust command ranges are at least partly overlapping. In other embodiments, the deflector and clutch thrust command ranges do not overlap. Thereby, one of the deflector and clutch thrust command ranges may start where the other one finishes.

In some embodiments, at the first thrust level, the deflector is controlled to deflect water for a substantially zero thrust. At the first thrust level, the clutch may be controlled to keep the impeller primed. The second thrust level may be a thrust level where the clutch is fully engaged. The second thrust level may be a thrust level where the deflector does not deflect any water flowing out of the outlet, e.g. in a case with a forward driving thrust. However, in a case where the thrust is a reversing thrust, the second thrust level may be a thrust level where the deflector deflects all water flowing out of the outlet.

Embodiments of the invention may be used for a start-up sequence of the vessel. Embodiments of the invention may be used for the vessel reaching a harbour and docking. Embodiments of the invention may involve a transition of the thrust level, from a first thrust level to a second thrust level. Thereby, the method may comprise controlling a first portion of the transition by gradually adjusting the position of the deflector, and controlling a second portion of the transition by gradually adjusting the level of engagement of the clutch.

Said transition of the thrust level may be in response to a transition of the thrust command level. The first portion of the transition may be provided within the deflector thrust command range. The clutch engagement level may be kept substantially constant during the first portion of the transition. The clutch may be controlled for keeping the impeller primed during the first portion of the transition. In the first portion of the transition, the deflector may be gradually adjusted from a position where water flowing out of the outlet is deflected for a substantially zero thrust level, to a position where no water is deflected, e.g. in a case with a forward driving thrust. However, in a case where the thrust is a reversing thrust, in the first portion of the transition, the deflector may be gradually adjusted from a position where water flowing out of the outlet is deflected for a substantially zero thrust level, to a position where all water is deflected.

The second portion of the transition may be provided within the clutch thrust command range. The deflector position may be kept substantially constant during the second portion of the transition.

As exemplified below, the first and second portions of the thrust level transition, may be in any mutual temporal order, e.g. the first portion followed by the second portion, or vice versa.

In embodiments of the invention, adjustments of the clutch and the deflector may be coordinated to obtain the transition of the thrust level, so that said transition of the thrust level is substantially continuous in a time domain. The derivative of the thrust level with respect to time may be above zero within the entire transition, or the derivative of the thrust level with respect to time is below zero within the entire transition. However, embodiments of the invention may involve the time derivative of the thrust level once or repetitively remaining at zero for a period of time, once or repetitively being positive for a period of time, and/or once or repetitively being negative for a period of time, e.g. within a transition of the thrust level, from the first thrust level to the second thrust level.

Embodiments of the invention comprises allowing or executing a clutch engagement step, wherein adjusting the position of the deflector comprises providing a compensation deflector position change at the clutch engagement step, so as to compensate for the clutch engagement step. Thereby, the deflector can be used to smoothen out steps in the impeller rotational speed due to the operation of the coupling. The clutch engagement step is different from a gradual change of the clutch engagement level. The clutch engagement step may result in a relatively large transition of the outlet flow, which transition lasts for a relatively short period of time. For example, the clutch engagement step may provide an outlet flow transition, of at least 5% of a total outlet flow range, which lasts no more than five seconds, e.g. around two seconds. For example, the clutch engagement step may provide an outlet flow transition, of at least 5% of a total outlet flow range, which lasts no more than five seconds, e.g. around two seconds. For example, the clutch engagement step may provide an impeller rotational speed transition, of at least 5% of a total impeller rotational speed range, which lasts no more than five seconds, e.g. around two seconds. The compensation deflector position change may be provided, or executed, in coordination with the clutch engagement step, so as to change the deflected flow, so as to provide a resulting thrust which is substantially the same as the thrust immediately before the clutch engagement step. Thereby, the thrust may be kept substantially continuous in a thrust command domain.

Where the clutch engagement step involves an increasing clutch engagement level, the compensation deflector position change may be such that it increases a deflected share of the flow of water out of the outlet. In particular, such a compensation deflector position change may be provided in a case of a forward driving thrust. In a case of a reversing thrust, and where the clutch engagement step involves an increasing clutch engagement level, the compensation deflector position change may be such that it decreases a deflected share of the flow of water out of the outlet.

Preferably, where the compensation deflector position change occurs at a first thrust command level, the method comprises controlling the thrust level of the water jet propulsion device, within a compensation thrust command range extending from the first thrust command level to a thrust command level that is higher than the first thrust command level, by adjusting the deflector position. Thereby, depending on whether there is a case of an increasing thrust command, or a decreasing thrust command, the compensation deflector position change may be followed, or preceded, respectively, by a deflector control so as to keep the thrust level substantially continuous in the thrust command domain. Thereby, the adjustment of the deflector is coordinated with the level of engagement of the clutch, so that the thrust level is substantially continuous in the thrust command domain. For example, in the case of an increasing thrust command, the compensation deflector position change may be from a first deflector position to a second deflector position, and, subsequently to the compensation deflector position change, the deflector position may be controlled so as to gradually change from the second position to the first position. Alternatively, in the case of a decreasing thrust command, the compensation deflector position change may be from the second deflector position to the first deflector position, and before the compensation deflector position change, the deflector position may be controlled so as to gradually change from the first position to the second position. Thus, where there is a clutch engagement step, the deflector may be used to take over a control of a gradual increase in the thrust. It should be noted that such embodiments of the invention may be provided in a case of a forward driving thrust, as well as in a case of a reversing thrust.

Within the compensation thrust command range, the clutch engagement level may be controlled, or allowed, so as for the clutch to be fully engaged. However, in some embodiments, the clutch may be less than fully engaged within the compensation thrust command range.

In embodiments of the invention, a hysteresis is provided, wherein clutch engagement steps are at different thrust levels depending on whether the respective step is reached during a thrust increase or a thrust decrease. Thereby, the clutch engagement level steps and the compensation deflector position changes may be different depending on whether the thrust is increased or decreased.

For example, where the clutch engagement step is a first clutch engagement step occurring at a first thrust command and when the thrust level is increased, and the compensation deflector position change is a first compensation deflector position change occurring at the first thrust command, the method may further comprise providing a second clutch engagement step occurring at a second thrust command and when the thrust level is decreased. The second thrust command may be different from the first thrust command. The second clutch engagement step may involve a decreasing clutch engagement level. Thereby, adjusting the position of the deflector may comprise providing, at the second clutch engagement step, a second compensation deflector position change so as to compensate for the second clutch engagement step. It should be noted that the second step can occur after or before the first step.

Thereby, a clutch engagement hysteresis is provided. The hysteresis is accompanied by the first and second compensation deflector position changes. Thereby, if the thrust command level is stationary for a period of time, at a step of the clutch engagement, a reciprocating engagement between two clutch levels may be avoided.

The object is also reached with a method for controlling a water jet propulsion device for the propulsion of a marine vessel, the water jet propulsion device comprising a conduit extending between an inlet and an outlet, an impeller in the conduit, and a mechanical power provider arranged to deliver power to the impeller, the method comprising receiving a plurality of thrust commands, and controlling a thrust level of the water jet propulsion device in dependence the thrust commands, the method further comprising controlling the thrust level of the water jet propulsion device, within a deflector thrust command range, by adjusting a position of a deflector arranged to deflect water flowing out of the outlet, and controlling the thrust level of the water jet propulsion device, within a clutch thrust command range, different from the deflector thrust command range, by adjusting a level of engagement of a clutch, arranged to adjust the delivery of power from the power provider to the impeller.

The object is also reached with a method for controlling a water jet propulsion device for the propulsion of a marine vessel, the water jet propulsion device comprising a conduit extending between an inlet and an outlet, an impeller in the conduit, and a mechanical power provider arranged to deliver power to the impeller, the method comprising controlling a thrust level of the water jet propulsion device, wherein controlling the thrust level comprises adjusting a position of a deflector arranged to deflect water flowing out of the outlet, the method further comprising allowing or executing an engagement step of a clutch, arranged to adjust the delivery of power from the power provider to the impeller, and providing a compensation deflector position change at the clutch engagement step, so as to compensate for the clutch engagement step.

The object is also reached with a computer program according to claim 15, a carrier according to claim 16, or a control module according to claim 17.

DESCRIPTION OF THE DRAWINGS

Below embodiments of the invention will be described with reference to the drawings in which.

DETAILED DESCRIPTION

Figure 1:
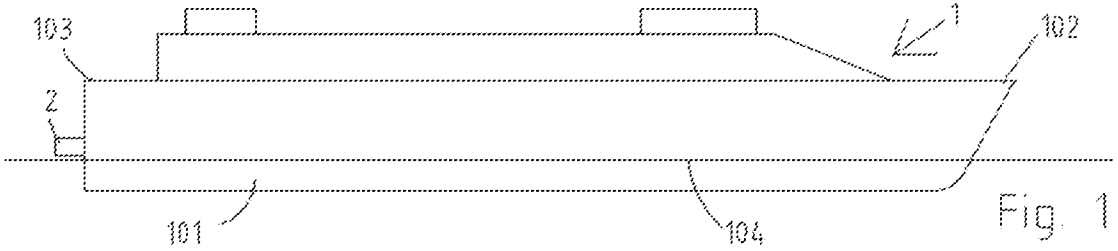
FIG. 1 shows a side view of a ship.
Figure 2:
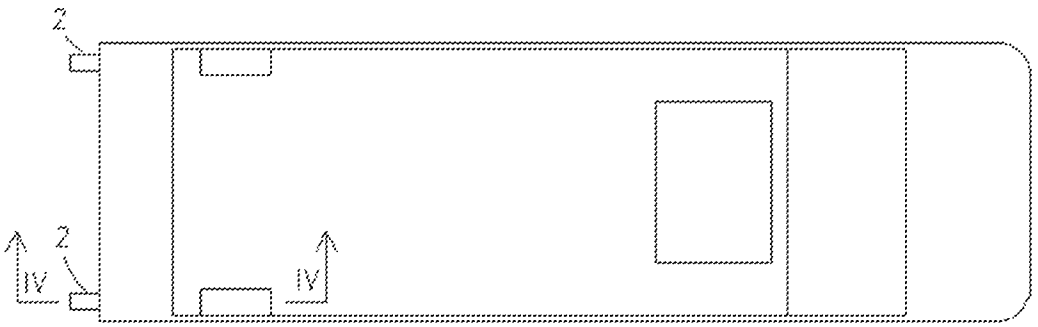
FIG. 2 shows a top view of the ship in FIG. 1.
Figure 3:
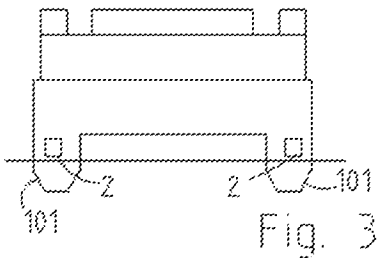
FIG. 3 shows a view from the back of the ship in FIG. 1.

FIG. 1, FIG. 2, and FIG. 3 show a side view, a top view, and a view from the back, respectively, of a marine vessel in the form of a catamaran passenger ship 1. The ship has two hulls 101, a bow 102, a stern 103 and a design waterline 104. It should be noted that the marine vessel could be of many different kinds, e.g. a single hull ship, a pleasure boat, or a jet ski boat.

The vessel is provided with two water jet propulsion devices 2 for the propulsion of the vessel. Each water jet propulsion device 2 is located at the stern 103. The water jet propulsion devices are located in a respective of the hulls 101.

Figure 4:
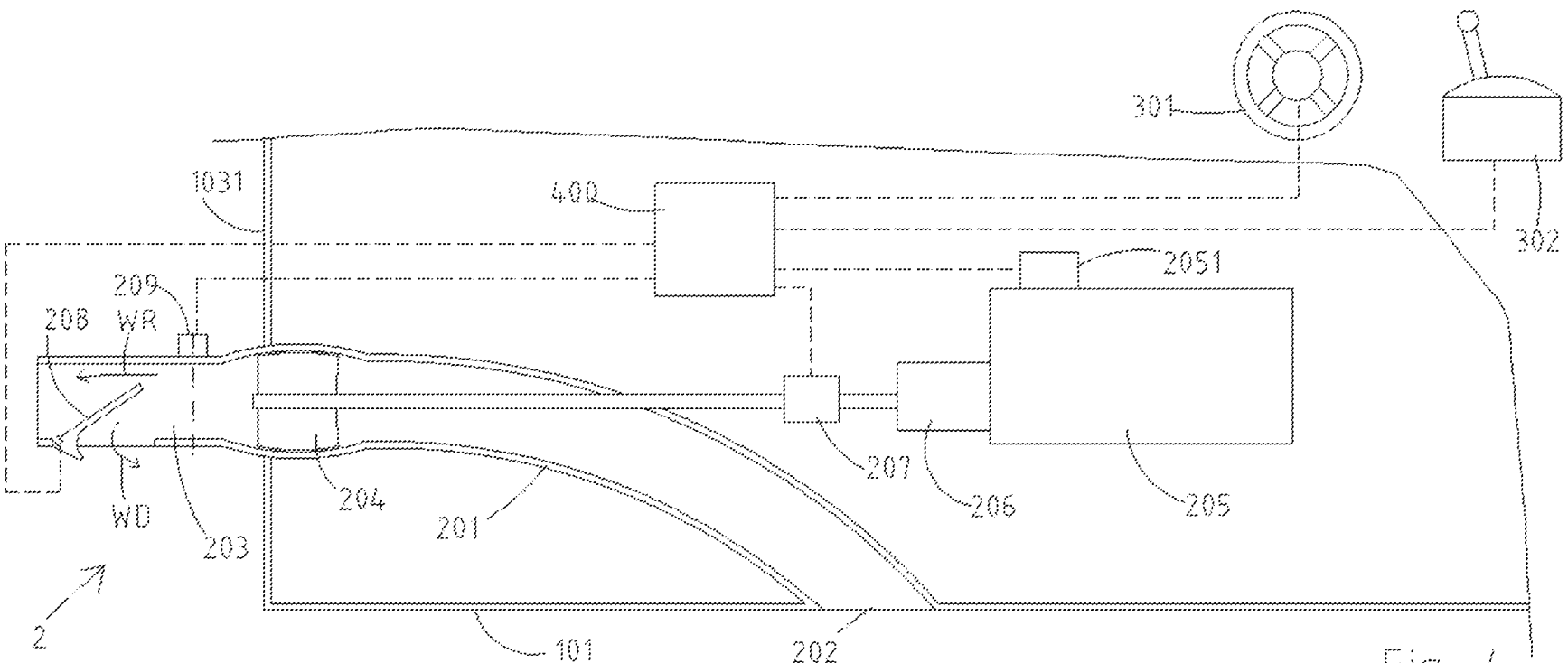
FIG. 4 shows a water jet propulsion device in the ship in FIG. 1, in a cross-section oriented as indicated by the arrows IV-IV in FIG. 2.

Reference is made also to FIG. 4, showing a schematic cross-section of one of the water jet propulsion devices of the ship. The water jet propulsion device comprises a conduit 201 extending between an inlet 202 and an outlet 203. The inlet is located at a bottom of the hull 101. The inlet is located beneath the waterline. The outlet 203 is located above the waterline. The outlet 203 is located in a transom 1031 of the stern.

An impeller 204 is provided in the conduit 201. The impeller is arranged to pump water from the inlet 202 to the outlet 203.

A mechanical power provider 205 is arranged to deliver power to the impeller. The power is delivered by an impeller shaft. The mechanical power provider 205 is in this example an internal combustion engine. The engine may be a piston engine. The engine may be may have any suitable power rating, e.g. as low as a few hp, or 2000 hp or above. In the case of a piston engine, it may have any suitable number of cylinders, e.g. one, two, four, six, eight, ten, twelve, sixteen, or twenty cylinders. Alternatively, the mechanical power provider 205 may be a gas turbine, an electric motor, a hybrid propulsion device, a hydraulic motor, a pneumatic motor, or the like. The mechanical power provider 205 may have any suitable rotational speed range, 500-2000 RPM.

The water jet propulsion device comprises a gearbox 206 between the mechanical power provider 205 and the impeller. The gearbox may have an input connected to a rotational member, e.g. a crankshaft, of the mechanical power provider 205. The gearbox may reduce the rotational speed of impeller in relation to the rotational speed of the mechanical power provider. The gearbox may reduce the rotational speed of impeller shaft in relation to the rotational speed of the mechanical power provider. The gearbox may have any suitable gear ratio, e.g. 2.7.

The water jet propulsion device comprises a clutch 207 between the gearbox and the mechanical power provider 205 and the impeller 204. More specifically, the clutch 207 is located between the gearbox 206 and the impeller 204. The clutch is located on the impeller shaft. In some embodiments, the clutch may be located in the gearbox. The gearbox may have an output connected to the clutch. The clutch may reduce the rotational speed of the impeller in relation to the rotational speed of the gearbox output.

The clutch is arranged to adjust the delivery of power from the power provider to the impeller. The clutch may assume different degrees, or levels of engagement. The clutch may provide a substantially continuous change of power to the impeller in a thrust command domain. Where a thrust command is continuous in a time domain, the clutch may provide a substantially continuous change of power to the impeller in a time domain. The clutch may be controlled by means of a hydraulic system (not shown). The clutch adjustment may be provided by means of a trolling valve of the hydraulic system. The trolling valve may be a proportional valve. By adjusting the trolling valve, the engagement level of the clutch may be controlled. The power provider may be controlled, e.g. for a constant rotational speed of the power provider, e.g. by controlling the fuel supply in the case of an engine.

The clutch may be a multidisc clutch. Oil may be provided between the discs of the clutch. The clutch may be a slip clutch. The clutch may form a torque converter. Hydraulic pressure may be used to bring the discs towards each other. Thereby, a stepless increase of the impeller rotational speed may be provided. Thereby, a stepless increase of the impeller torque may be provided.

The water jet propulsion device comprises a deflector 208 arranged to deflect water flowing out of the outlet 203. Thereby, the thrust of the water jet propulsion device may be controlled. The deflector may be provided in the form of a reversing plate, or a bucket.

The deflector may be set to a position, a no deflection position, where no water flowing out of the outlet is deflected, giving a thrust for driving the vessel forward. The deflector may be set to another position, a zero thrust position, where a portion of the water flowing out of the outlet is deflected forwards, as indicated in FIG. 4 with the arrow WD, and the remainder of the water flowing out of the outlet is not deflected, as indicated in FIG. 4 with the arrow WR. The zero thrust position gives a zero thrust. The deflector may also be set to a further position, a full deflection position, where all water flowing out of the outlet is deflected, giving a reversing thrust.

The deflector may set to a plurality of positions, or any position, between the no deflection position and the full deflection position. In particular, in cases of a forward driving thrust, the deflector may set to a plurality of positions, or any position, between the zero thrust position and the no deflection position. In cases of a reversing thrust, the deflector may set to a plurality of positions, or any position, between the zero thrust position and the full deflection position. Thereby, the deflector may provide a substantially continuous change of thrust in a thrust command domain. Where the thrust command is continuous in a time domain, the deflector may provide a substantially continuous change of thrust in the time domain.

The water jet propulsion device further comprises a steering device 209, arranged to swing the outlet 203 around a substantially vertical axis. Thereby, the vessel may be steered while travelling.

The vessel further comprises one or more control devices for control of the vessel propulsion. The control devices may be adapted to be handled by a person. Alternatively, one or more control devices may be formed by an automatic vessel control module, for automatic, or semi-automatic vessel control. In this example, the vessel comprises a control device in the form of a thrust command device 302. The vessel further comprises a control device in the form of a steering wheel 301.

The vessel further comprises a control module 400 arranged to receive signals from the control devices 301, 302. In particular, the control module 400 is arranged to receive signals, indicative of thrust commands, from the thrust command device 302. The control module 400 is further adapted to control, in dependence of the received signals, members of the water jet propulsion device. Thereby, the control module 400 is adapted to control a thrust level of the water jet propulsion device in dependence the thrust commands. The thrust level may have a substantially proportional relationship to the thrust level command.

More specifically, the control module 400 is adapted to control the mechanical power provider 205, in dependence of signals from the thrust command device 302, e.g. by means of an engine controller 2051. Further, the control module 400 is adapted to control the clutch 207, in dependence of signals from the thrust command device 302. Further, the control module 400 is adapted to control the deflector 208, in dependence of signals from the thrust command device 302.

In addition, the control module 400 is adapted to control the steering device 209, e.g. in dependence of signals from the steering wheel 301.

The control module may be arranged to receive signals indicative of the rotational speed of the impeller. The signals may be provided by means of one or more sensors; (not shown). The control module may be arranged to control the clutch engagement level in dependence on the rotational speed of the impeller. Thus, a closed loop may be provided for the impeller rotational speed control. The control module may further be arranged to receive signals indicative of the rotational speed of the power provider. Thereby, the control module may be arranged to control the clutch engagement level in dependence on the rotational speeds of the impeller and the power provider.

Figure 5:
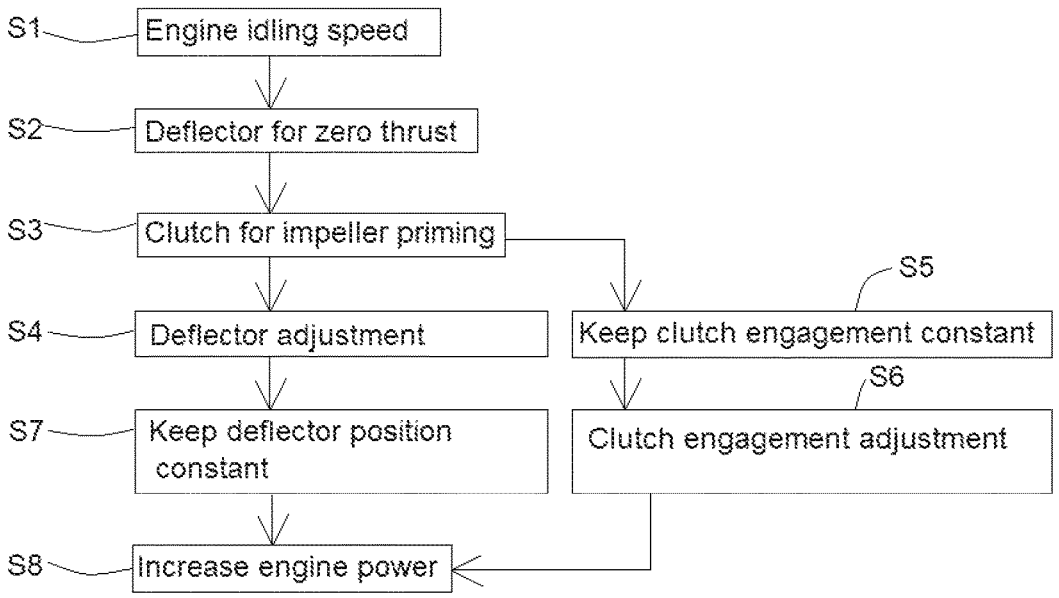
FIG. 5 is a flow diagram depicting steps in a method of an embodiment of the invention, for controlling the water jet propulsion device in FIG. 4.

Reference is made also to FIG. 5, showing a flow diagram depicting steps in a method of an embodiment of the invention, for controlling the water jet propulsion device. The method may be a part of a vessel start-up sequence. Thereby the water jet propulsion device is controlled so as to increase the thrust. The method according to the various embodiments herein may be performed by the control module 400.

The method includes a coordinated control of the clutch 207 and the deflector 208 for a transition from a first thrust level of the water jet propulsion device 2, to a second thrust level of the water jet propulsion device, wherein the transition is substantially continuous in a thrust command domain.

Figure 6:
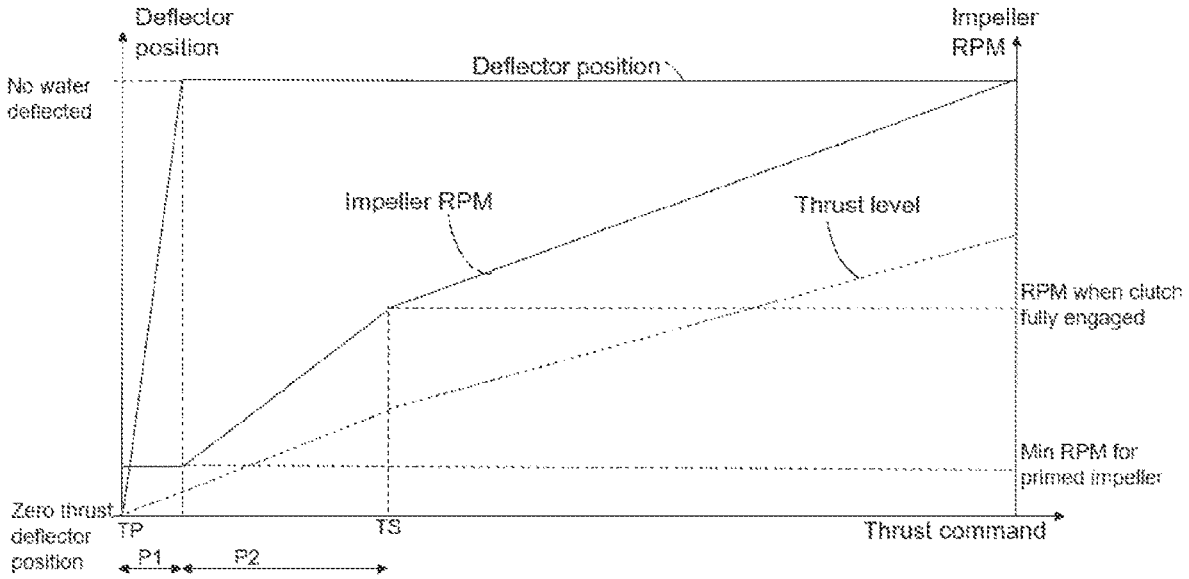
FIG. 6 is a diagram of parameters, in the method in FIG. 5, of members of the water jet propulsion device, as functions of a propulsion device thrust command.

Reference is made also to FIG. 6, showing a diagram of the rotational speed of the impeller 204, and the position of the deflector 208, as functions of the water jet propulsion device thrust command, e.g. as given by the position of the thrust command device 302. FIG. 6 also indicates the water jet propulsion device thrust level, as a function of the water jet propulsion device thrust command. In this example, the thrust level is at zero in the lower end of the thrust command range, i.e. at the left side of the diagram, and increases as the thrust command level increases, i.e. moving to the right in the diagram.

The first thrust level is substantially a zero thrust. The first thrust level is for this example assumed to correspond to a primary thrust command TP. Thereby, the engine 205 is controlled S1 so as to run at idling speed. Further, at the first thrust level, the deflector is controlled S2 to deflect water for a substantially zero thrust.

The impeller may be at least partly above the level of water surrounding the vessel. This means that when the water jet propulsion device is shut down, the impeller may be at least partly surrounded by air. Therefore, at the first thrust level, the clutch is controlled for getting the impeller 204 primed. Thereby, the impeller rotational speed is high enough to allow water to enter air filled parts of the conduit 201, and to thereby surround the impeller. For this, the clutch engagement level may be at 100%, i.e. full engagement. For getting the impeller 204 primed, the engine may remain at idle speed, or it may be controlled for a higher rotational speed, e.g. depending on the installation height of the impeller in relation to the water line.

Further, at the first thrust level, the clutch is controlled S3 for keeping the impeller primed. This may be done after the impeller has gotten primed. The clutch engagement may be adapted for a minimal rotational speed of the impeller to keep the impeller primed. Thereby, the impeller rotational speed is high enough to allow water to flow through the conduit 201. Thereby, the impeller rotational speed is high enough to allow the impeller to be surrounded by water. For this, the clutch engagement level may be at 20-40%, e.g. about 30%. Thereby, for a water jet propulsion device as in this example, the impeller rotational speed may be at e.g. 40-70 RPM, e.g. about 55 RPM. In some embodiments, the impeller rotational speed for keeping the impeller primed may be close to zero rpm. Thus, once the impeller has gotten primed, the impeller rotational speed may be reduced, and still be high enough to keep the impeller primed. The impeller rotational speed reduction may be done by reducing the clutch engagement level.

A first portion of the transition from the first thrust level to the second thrust level is controlled by adjusting S4 the deflector position. Depending on the thrust commands, this adjustment may be gradual. The deflector may be adjusted from the zero thrust position, to a position where no water is deflected. Meanwhile, the clutch engagement level is kept S5 constant, e.g. so as to keep the impeller primed. In some embodiments however, the clutch engagement could be gradually increased while the deflector is gradually adjusted to decrease the portion of the outlet flow that is deflected. The first portion of the transition may coincide with a deflector thrust command range P1. Within the deflector thrust command range, the clutch is controlled so as for the clutch to be partially engaged, e.g. so as to keep the impeller primed.

It should be noted that in the first portion of the transition, the deflector position may not necessarily change in a single direction. There may be within the first portion one or more movements of the deflector in one direction, and possibly also one or more movements in the opposite direction. Further, there may be in the first portion of the transition, one or more periods of time with a constant deflector position. The first portion of the transition provides a low speed control of the vessel. Depending on the navigation, weather, and/or surrounding traffic, the first portion of the transition may in practice last for any suitable period of time, e.g. from a fraction of a minute to 30 minutes or more.

A second portion P2 of the transition from the first thrust level to the second thrust level is controlled by adjusting S6 a level of engagement of the clutch 207. Depending on the thrust commands, this adjustment may be gradual. The clutch may be adjusted, from the level where the impeller 204 is kept primed, to a full clutch engagement. The second thrust level is in this example assumed to correspond to a secondary thrust command TS. The deflector position is kept S7 constant during the second portion of the transition from the first thrust level to the second thrust level. Thereby, for a water jet propulsion device as in this example, the impeller rotational speed may be at e.g. 150-250 RPM, e.g. about 183 RPM. The second portion of the transition may coincide with a clutch thrust command range P2.

It should be noted that in the second portion of the transition, the clutch engagement may not necessarily change in a single direction. There may be within the second portion one or more clutch engagement level changes in one direction, and possibly also one or more changes in the opposite direction. Further, there may be in the second portion of the transition, one or more periods of time with a constant clutch engagement level.

As result of the method according to the embodiment described here, the thrust level of the water jet propulsion device is, as indicated in FIG. 6, continuous in the thrust command domain.

Subsequently to the coordinated control of the clutch and the deflector, the power provider 205 is controlled S8 to increase the power to the impeller. Thereby, the flow of water out of the outlet 203 is increased.

When the water jet propulsion device is controlled so as to decrease the thrust, the steps S1-S8 may be performed in a reversed order.

The example described with reference to FIG. 5 and FIG. 6, may be a case of a forward driving thrust. In a case of an increasing reversing thrust, the deflector adjustment S4 may involve increasing a deflected portion of the outlet flow, until all water is deflected. Further, during the clutch adjustment S6 the deflector may be kept S7 in a position in which all water is deflected.

Figure 7:
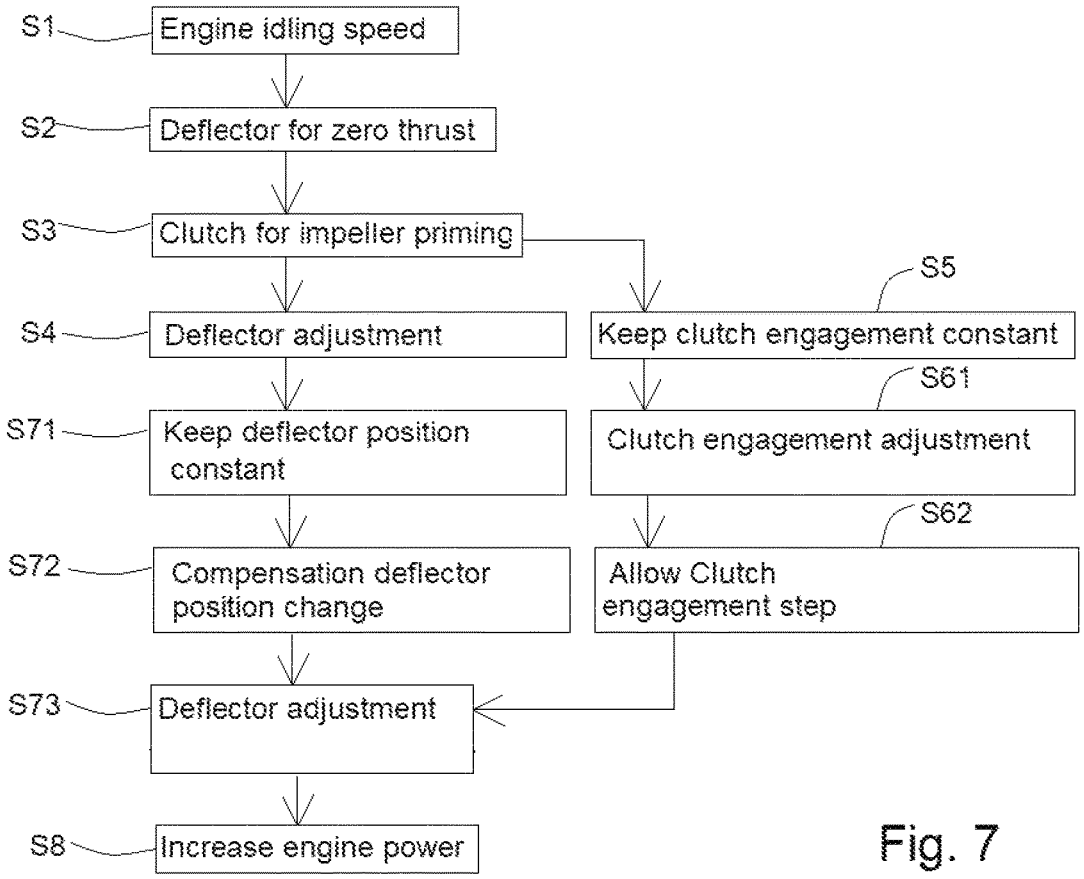
FIG. 7 is a flow diagram depicting steps in a method of another embodiment of the invention, for controlling the water jet propulsion device in FIG. 4.

Reference is made to FIG. 7, showing a flow diagram depicting steps in a method of a further embodiment of the invention, for controlling a water jet propulsion device. Steps S1-S5 are the same as in the method described above with reference to FIG. 5.

Figure 8:
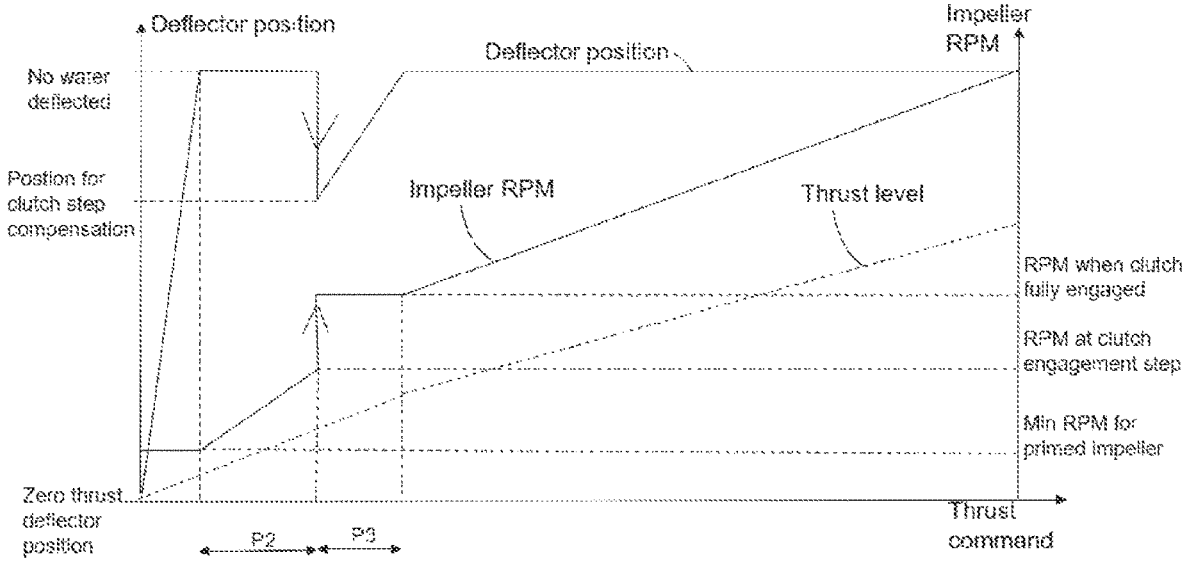
FIG. 8 is a diagram of parameters, in the method in FIG. 7, of members of the water jet propulsion device, as functions of a propulsion device thrust command.

Reference is made also to FIG. 8. Subsequently to the adjustment S4 of the deflector position, from the zero thrust position, to the position where no water is deflected, the clutch engagement level is adjusted S61, from the level where the impeller 204 is kept primed, to a threshold clutch engagement level where there is a step of the clutch engagement to a full clutch engagement. Here, the thrust level, where no water is deflected and the clutch is engaged so as to keep the impeller primed, is referred to as the first thrust level. During this clutch adjustment S61, the deflector position is kept S71 so as for no water to be deflected. This deflector position is for this embodiment referred to as a first deflector position. Depending on the thrust commands, the clutch engagement level adjustment S61 may be gradual. The clutch engagement level adjustment S61 may coincide with a clutch thrust command range P2.

Upon the clutch reaching the threshold clutch engagement level, the step of the clutch engagement, from the threshold clutch engagement level to the full clutch engagement, is allowed S62. The threshold clutch engagement level is herein also referred to as a first clutch engagement level. The full clutch engagement is herein also referred to as a second clutch engagement level. At the full engagement, discs of the clutch may be in contact with each other. At the threshold clutch engagement level, before the clutch engagement step occurs, the clutch engagement level may be at e.g. 60-80%, e.g. about 70%. Thereby, for a water jet propulsion device as in this example, the impeller rotational speed may be at e.g. 110-150 RPM, e.g. about 128 RPM. The clutch engagement step may be due to a step from a condition with a minimal distance between clutch discs with oil between them, and the condition with direct contact between the clutch discs.

Simultaneously to allowing the clutch engagement step, a compensation deflector position change is executed. Thereby, the deflector position is changed S72 from the first deflector position to a second deflector position so as to compensate for the clutch engagement step. The compensation deflector position change S72 may be substantially stepwise. The compensation deflector position change is adapted to that the resulting thrust change, at the clutch engagement step S62, is substantially zero.

Thus, the clutch engagement step is a step from the first clutch engagement level to the second clutch engagement level, the second clutch engagement level being higher than the first clutch engagement level, wherein, in the second deflector position, more water flowing out of the outlet is deflected, than in the first deflector position.

Subsequently to the change of the deflector position from the first position to the second position, the deflector position is controlled S73 so as to change from the second position, back to the first position. Depending on the thrust commands, this change S73 may be gradual. The change of the deflector position from the second position, back to the first position, may coincide with a compensation thrust command range P3 in the thrust command domain. Preferably, where the power provider is an engine, within the compensation thrust command range, the engine is controlled so as to be idling.

When the deflector is positioned so that no water is deflected, and the clutch is in full engagement, the power provider 205 is controlled S8 to increase the power to the impeller. Thereby, the flow of water out of the outlet 203 is increased. Here, the thrust level where no water is deflected and the clutch is in full engagement, is referred to as the second thrust level.

Figure 9:
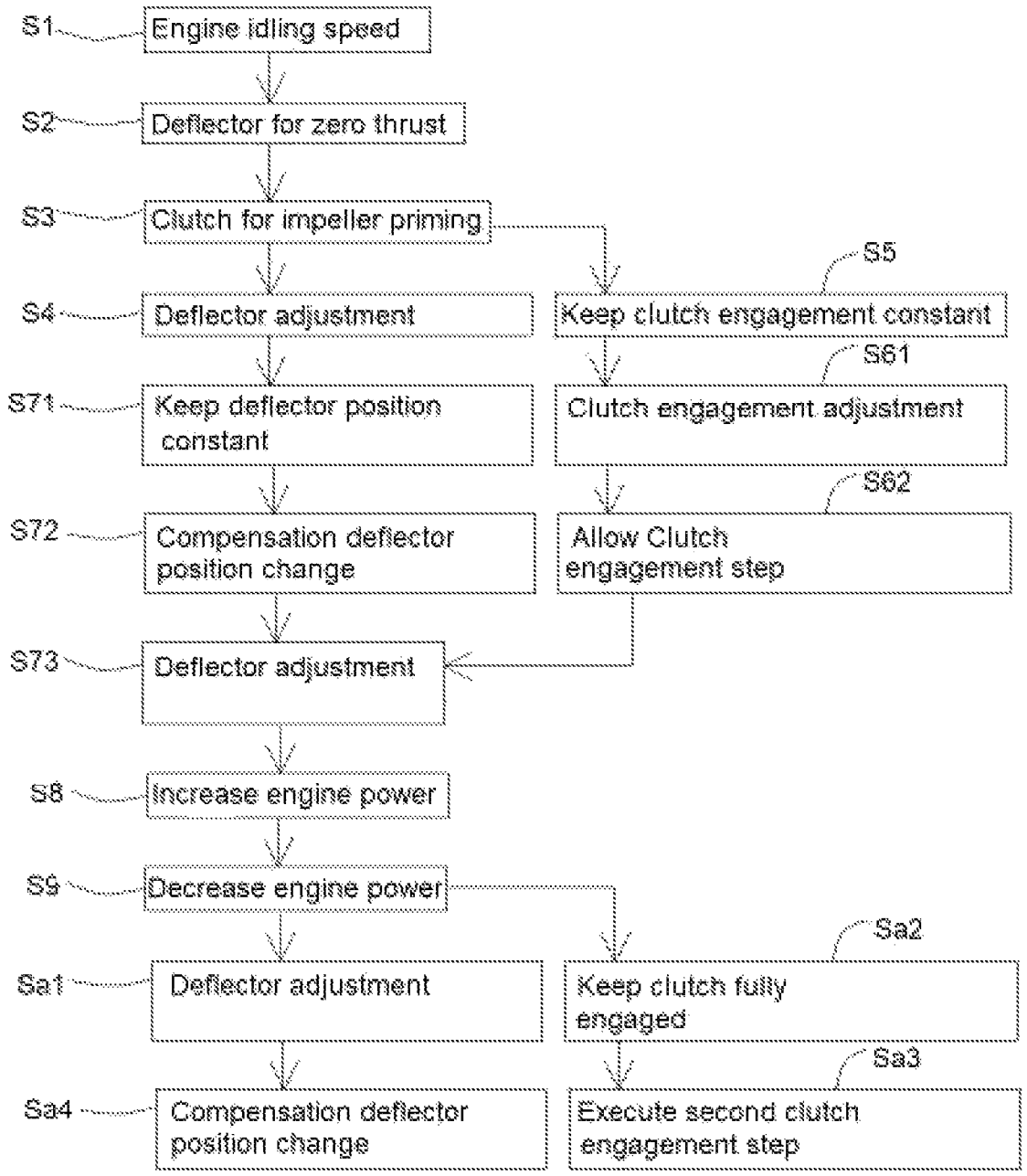
FIG. 9 is a flow diagram depicting steps in a method of a further embodiment of the invention, for controlling the water jet propulsion device in FIG. 4.

Reference is made to FIG. 9, showing a flow diagram depicting steps in a method of another embodiment of the invention, for controlling a water jet propulsion device. Steps S1-S8 are the same as in the method described above with reference to FIG. 7.

Figure 10:
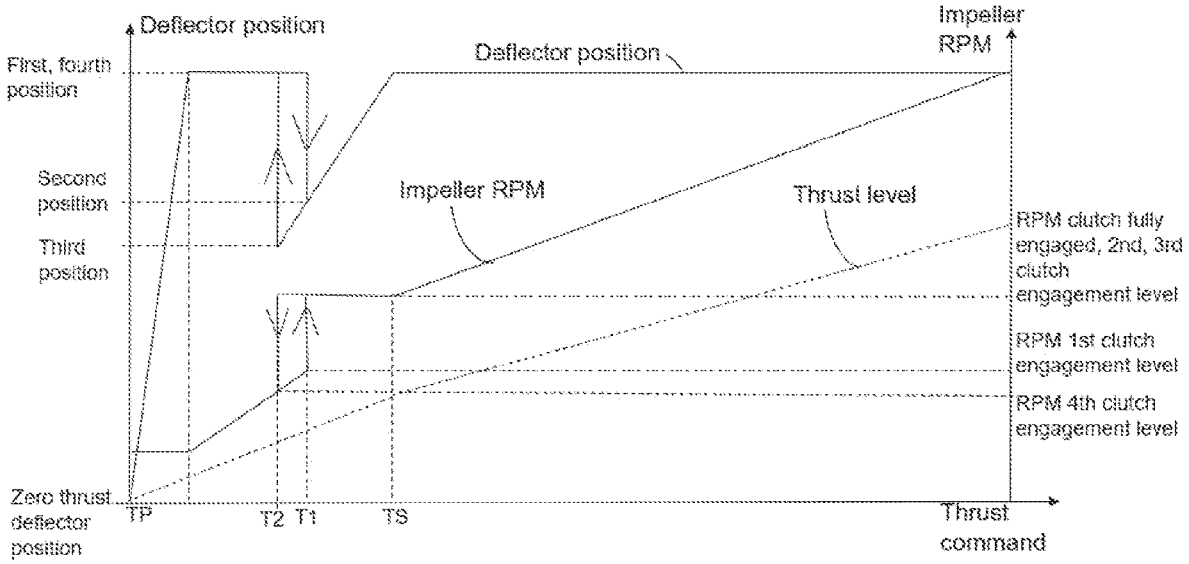
FIG. 10 is a diagram of parameters, in the method in FIG. 9, of members of the water jet propulsion device, as functions of a propulsion device thrust command.

Reference is made also to FIG. 10. In the method according to this embodiment, a hysteresis is provided, wherein clutch engagement steps are at different thrust levels depending on whether the respective step is reached during a thrust increase or a thrust decrease. Thereby, where the thrust command level is constant for some time, a reciprocating change between a fully engaged clutch condition, and a partially engaged clutch condition, may be avoided.

Here, the clutch engagement step S62 is referred to as a first clutch engagement step occurring at a first thrust command T1. As understood, the first clutch engagement step occurs at an increase of the thrust. The compensation deflector position change S72 is referred to as a first compensation deflector position change occurring at the first thrust command T1. As understood, the first compensation deflector position change occurs at the increase of the thrust.

As suggested with reference to FIG. 7 and FIG. 8, subsequently to the first clutch engagement step and the first compensation deflector position change, the deflector position is controlled S73 so as to change from the second position, back to the first position. This change may be gradual. Thereafter, the power provider 205 is controlled S8 to increase the power to the impeller.

The method according to this embodiment may comprise controlling S9 engine to decrease the engine rotational speed. This may be done until the secondary thrust command TS has been reached. Subsequently, as the thrust command decreases, the deflector position is controlled Sa1 so as to change from the first position, in which no water is deflected, to a third position in which a portion of the water flowing out of the outlet is deflected. Depending on the thrust commands, this change Sa1 may be gradual. Simultaneously, the clutch is kept Sa2 in the second engagement level, i.e. fully engaged. Herein, for the case of a thrust decrease, the clutch full engagement is also referred to as a third engagement level. Thus, in this example, the second and third engagement levels are the same. However, in some embodiments, the second and third engagement levels may be different.

The deflector position change Sa1, and the keeping Sa2 of the clutch in the fully engaged position, is done until a second thrust command T2 is reached. The second thrust command is lower than the first thrust command T1. In the third deflector position, occurring during the thrust decrease, more water is deflected than in the second deflector position at the first clutch engagement step (at the first thrust command T1) occurring during the thrust increase.

At the second thrust command T2, a second clutch engagement step is executed Sa3, from the full clutch engagement to a fourth clutch engagement level. Since the second thrust command T2 is lower than the first thrust command T1, the second clutch engagement step Sa3 is larger than the first clutch engagement step S62. Thus, the fourth clutch engagement level, reached at the second clutch engagement step Sa3, is lower than the first clutch engagement level, from which the first clutch engagement step S62 proceeds.

At the second clutch engagement step, a second compensation deflector position change Sa4 is provided, so as to compensate for the second clutch engagement step. The second compensation deflector position change Sa4 is from the third deflector position to a fourth deflector position. In the third deflector position, more water flowing out of the outlet is deflected, than in the fourth deflector position. In this example, no water is deflected in the fourth deflector position. I.e. in this example, the first deflector position is the same as the first deflector position.

Thus, a hysteresis is provided, wherein clutch engagement steps are at different thrust levels depending on whether the respective step is reached during a thrust increase or a thrust decrease.

Figure 11:
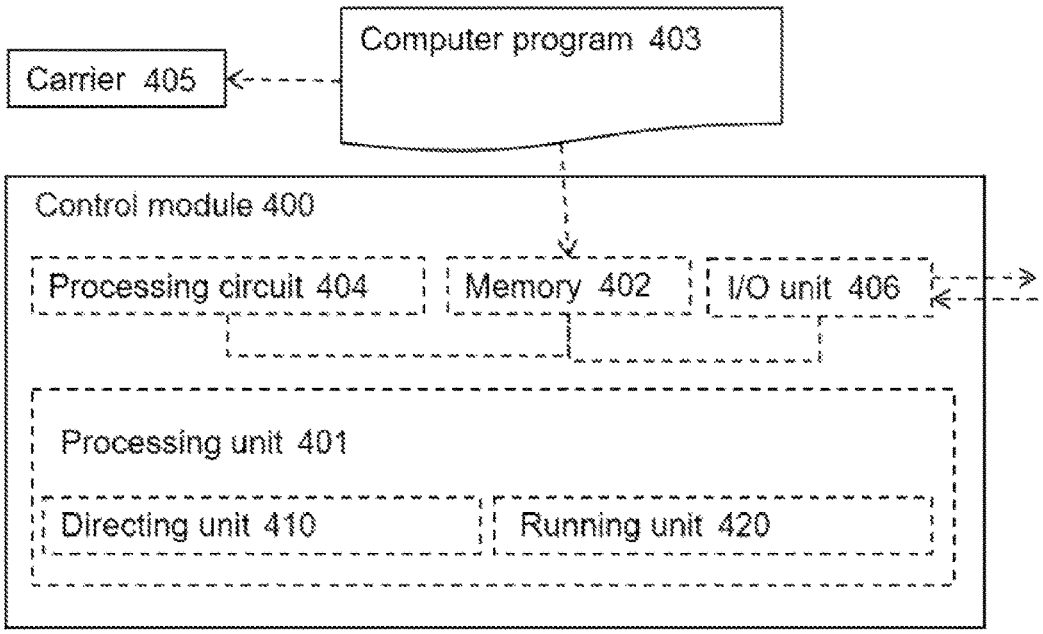
FIG. 11 is a block diagram, illustrating a control module used for methods of embodiments of the invention.

With reference to FIG. 11, a schematic block diagram of embodiments of the control module 400 of FIG. 4 is shown. The control module 400, such as a computer, a processing device, an automation control unit etc., may be comprised in the ship 1, the hull structure 10, or the like.

The control module 400 may comprise a processing module 401, such as a means for performing the methods described herein. The means may be embodied in the form of one or more hardware modules and/or one or more software modules. The term "module" may thus refer to a circuit, a software block or the like according to various embodiments as described below.

The control module 400 may further comprise a memory 402. The memory may comprise, such as contain or store, instructions, e.g. in the form of a computer program 403, which may comprise computer readable code units.

According to some embodiments herein, the control module 400, e.g. the processing module 401 thereof, comprises a processing circuit 404 as an exemplifying hardware module. Accordingly, the processing module 401 may be embodied in the form of, or 'realized by', the processing circuit 404. The instructions may be executable by the processing circuit 404, whereby the control module 400 is operative to perform a method of an embodiment of the invention. As another example, the instructions, when executed by the control module 400, e.g. the processing module 401 thereof, may cause the control module 400 to perform a method of an embodiment of the invention.

FIG. 4 further illustrates a carrier 405, or program carrier, which provides, such as comprises, mediates, supplies and the like, the computer program 403 as described above. The carrier 405 may be one of an electronic signal, an optical signal, a radio signal and a computer readable medium.

In further embodiments, the control module 400, e.g. the processing module 401 thereof, may comprise one or more of a directing module 410 and a running module 420 as exemplifying hardware modules. The term "module" may refer to a circuit when the term "module" refers to a hardware module. In other examples, one or more of the aforementioned exemplifying hardware modules may be implemented as one or more software modules.

Moreover, the control module 400, e.g. the processing module 401 thereof, may comprise an Input/Output module 406, which may be exemplified by a receiving module and/or a sending module when applicable. The receiving module may receive commands and/or information from various devices, and the sending module may send commands and/or information to various devices.

The invention claimed is:

1. A method for controlling a water jet propulsion device for the propulsion of a marine vessel, the water jet propulsion device comprising a conduit extending between an inlet and an outlet, an impeller in the conduit, and a mechanical power provider arranged to deliver power to the impeller, the method comprising:

receiving a plurality of thrust commands; and controlling a thrust level of the water jet propulsion device in dependence of the thrust commands, wherein controlling the thrust level comprises adjusting a position of a deflector arranged to deflect water flowing out of the outlet, characterised by coordinating the adjustment of the position of the deflector with a level of engagement of a clutch, arranged to adjust the delivery of power from the power provider to the impeller, so that the thrust level is substantially continuous in a thrust command domain.

2. A method according to claim 1, comprising controlling the thrust level of the water jet propulsion device, within a deflector thrust command range, by the adjustment of the deflector, and controlling, within the deflector thrust command range, the level of engagement of the clutch, so as for the clutch to be partially engaged.

3. A method according to claim 2, comprising keeping the clutch engagement level substantially constant within the deflector thrust command range.

4. A method according to claim 2, comprising controlling the clutch for keeping the impeller primed within the deflector thrust command range.

5. A method according to claim 2, comprising controlling, at a lower end of the deflector thrust command range, the deflector so as to deflect water for a substantially zero thrust.

6. A method according to claim 2, comprising controlling the thrust level of the water jet propulsion device, within a clutch thrust command range, different from the deflector thrust command range, by adjusting the level of engagement of the clutch.

7. A method according to claim 6, wherein, at a higher end of the clutch thrust command range, the clutch is fully engaged.

8. A method according to claim 6, comprising keeping the deflector position substantially constant within the clutch thrust command range.

9. A method according to claim 6, wherein the clutch thrust command range extends from a priming minimum level with a clutch engagement level providing a substantially minimal rotational speed of the impeller to keep the impeller primed, to a thrust level that is higher than at the priming minimum level.

10. A method according to claim 1, comprising allowing or executing a clutch engagement step, wherein adjusting the position of the deflector comprises providing a compensation deflector position change at the clutch engagement step, so as to compensate for the clutch engagement step.

11. A method according to claim 10, wherein the clutch engagement step involves an increasing clutch engagement level, wherein the compensation deflector position change is such that it increases a deflected share of the flow of water out of the outlet.

12. A method according to claim 10, wherein the compensation deflector position change occurs at a first thrust command level, the method comprising controlling the thrust level of the water jet propulsion device, within a compensation thrust command range extending from the first thrust command level to a thrust command level that is higher than the first thrust command level, by adjusting the deflector position.

13. A method according to claim 12, comprising controlling or allowing, within the compensation thrust command range, the clutch engagement level so as for the clutch to be fully engaged.

14. A method according to claim 10, wherein the clutch engagement step is a first clutch engagement step occurring at a first thrust command and when the thrust level is increased, and the compensation deflector position change is a first compensation deflector position change occurring at the first thrust command, the method further comprising providing a second clutch engagement step occurring at a second thrust command and when the thrust level is decreased, the second thrust command being different from the first thrust command, wherein the second clutch engagement step involves a decreasing clutch engagement level, wherein adjusting the position of the deflector comprises providing, at the second clutch engagement step, a second compensation deflector position change so as to compensate for the second clutch engagement step.

15. A computer program, comprising computer readable code units which when executed on a control module causes the control module to perform the method according to claim 1.

16. A carrier comprising the computer program according to claim 15, wherein the carrier is one of an electronic signal, an optical signal, a radio signal and a computer readable medium.

17. A control module configured to perform the method according to claim 1.

* * * * *